US011465301B2

(12) United States Patent
Horowitz et al.

(10) Patent No.: US 11,465,301 B2
(45) Date of Patent: Oct. 11, 2022

(54) HAIR-CUTTING UNIT FOR A SHAVING DEVICE

(71) Applicant: KONINKLIJKE PHILIPS N.V., Eindhoven (NL)

(72) Inventors: Dmitri Horowitz, Leeuwarden (NL); Marcus Cornelis Petrelli, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 2 days.

(21) Appl. No.: 17/272,950

(22) PCT Filed: Sep. 13, 2019

(86) PCT No.: PCT/EP2019/074445
§ 371 (c)(1),
(2) Date: Mar. 3, 2021

(87) PCT Pub. No.: WO2020/058106
PCT Pub. Date: Mar. 26, 2020

(65) Prior Publication Data

US 2021/0197413 A1 Jul. 1, 2021

(30) Foreign Application Priority Data

Sep. 21, 2018 (EP) ..... 18196049

(51) Int. Cl.
*B26B 19/14* (2006.01)

(52) U.S. Cl.
CPC ..... *B26B 19/145* (2013.01)

(58) Field of Classification Search
CPC ..... B26B 19/00; B26B 19/14; B26B 19/141; B26B 19/143; B26B 19/145; B26B 19/146–148
(Continued)

(56) References Cited

U.S. PATENT DOCUMENTS 3,242,569 A * 3/1966 Van Der Driest ..... B26B 19/14 30/43.5
3,844,033 A * 10/1974 Yonkers ..... B26B 19/14 30/346.51
(Continued)

FOREIGN PATENT DOCUMENTS

CN 101362341 2/2009
EP 1063066 12/2000
(Continued)

OTHER PUBLICATIONS

International Search Report and Written Opinion dated Dec. 12, 2019 for International Application No. PCT/EP2019/074445 Filed Sep. 13, 2019.

*Primary Examiner* — Jason Daniel Prone
*Assistant Examiner* — Richard D Crosby, Jr.

(57) ABSTRACT

A hair-cutting unit for a shaving device, the hair-cutting unit including a hair-cutting element and a telescopic drive-shaft. The drive-shaft comprises a first shaft-segment, which is in telescopic engagement with a co-rotating second shaft-segment, which itself is in telescopic engagement with a co-rotating third shaft-segment. A spring presses the first telescopic shaft-segment and the third telescopic shaft-segment away from one another. In an embodiment, the first and second telescopic shaft-segments are in mutual tillable engagement, and/or the second and third telescopic shaft-segments are in mutual tillable engagement.

13 Claims, 4 Drawing Sheets

(58) Field of Classification Search
USPC ..... 30/43.4–43.6, 264
See application file for complete search history.

(56) References Cited

U.S. PATENT DOCUMENTS

| | | | | |
|---|---|---|---|---|
| 4,001,932 | A * | 1/1977 | Herrick | B26B 19/14 30/43.5 |
| 4,137,629 | A * | 2/1979 | Yamazaki | B26B 19/14 30/43.5 |
| 4,257,161 | A * | 3/1981 | Bijl | B26B 19/145 464/158 |
| 4,910,869 | A * | 3/1990 | Labrijn | B26B 19/3866 30/43.6 |
| 5,031,315 | A * | 7/1991 | Labrijn | B26B 19/48 30/44 |
| 6,581,289 | B2 * | 6/2003 | Nakano | B26B 19/141 30/346.51 |
| 9,027,251 | B2 * | 5/2015 | Schmitt | B26B 19/14 30/41 |
| 9,266,246 | B2 * | 2/2016 | Schmitt | B26B 19/14 |
| 9,592,614 | B2 * | 3/2017 | Oosterhoff | B26B 19/146 |
| 10,279,492 | B2 * | 5/2019 | Phoon | B26B 19/28 |
| 10,357,890 | B2 * | 7/2019 | Yan | B26B 19/146 |
| 10,449,682 | B2 * | 10/2019 | Eijkelkamp | B26B 19/386 |
| 10,933,545 | B2 * | 3/2021 | Lap | B26B 19/38 |
| 11,267,145 | B2 * | 3/2022 | Horowitz | B26B 19/28 |
| 2002/0017022 | A1 * | 2/2002 | Nakano | B26B 19/141 30/43.6 |
| 2003/0019107 | A1 * | 1/2003 | Visman | B26B 19/14 30/346.51 |
| 2005/0241153 | A1 * | 11/2005 | Koike | B26B 19/145 30/43.6 |
| 2007/0022605 | A1 * | 2/2007 | Morisugi | B26B 19/148 30/43.4 |
| 2007/0084059 | A1 * | 4/2007 | Hannan | B26B 19/145 30/43.5 |
| 2008/0034591 | A1 * | 2/2008 | Fung | B26B 19/048 30/529 |
| 2010/0275446 | A1 * | 11/2010 | Schmitt | B26B 19/146 30/43.4 |
| 2011/0030220 | A1 * | 2/2011 | Shimizu | B26B 19/145 30/527 |
| 2011/0173815 | A1 * | 7/2011 | Koike | B26B 19/145 30/43.6 |
| 2013/0019480 | A1 * | 1/2013 | Schneider | B26B 19/382 30/41.6 |
| 2015/0224654 | A1 * | 8/2015 | Steur | B26B 19/14 30/43.6 |
| 2016/0052153 | A1 * | 2/2016 | Oosterhoff | B26B 19/146 30/43.6 |
| 2017/0120466 | A1 * | 5/2017 | Phoon | B26B 19/386 |
| 2019/0337171 | A1 * | 11/2019 | Lap | B26B 19/145 |
| 2019/0381680 | A1 * | 12/2019 | Lap | B26B 19/145 |
| 2019/0389084 | A1 * | 12/2019 | Lap | B26B 19/145 |

FOREIGN PATENT DOCUMENTS

| | | |
|---|---|---|
| EP | 1902818 | 3/2008 |
| JP | S62100341 U | 6/1987 |
| JP | 2011067421 A | 4/2011 |
| WO | 2004/065078 | 8/2004 |

* cited by examiner

HAIR-CUTTING UNIT FOR A SHAVING DEVICE

CROSS REFERENCE TO RELATED APPLICATIONS

This application is the U.S. National Phase application under 35 U.S.C. § 371 of International Application No. PCT/EP2019/074445 filed Sep. 13, 2019, which claims the benefit of European Patent Application Number 18196049.3 filed Sep. 21, 2018. These applications are hereby incorporated by reference herein.

FIELD OF THE INVENTION

The invention relates to a hair-cutting unit for a shaving device, wherein the hair-cutting unit comprises a hair-cutting element and a drive-shaft mechanism for rotatingly driving the hair-cutting element. A shaving device for skin hairs may comprise one or more of such hair-cutting units according to the present invention. Typically, a shaving device for skin hairs further comprises a shaving device main body, which is intended to be taken hold of by a user of the shaving device, and which serves for accommodating various members of the shaving device.

BACKGROUND OF THE INVENTION

As a general background of the present invention it is noted that US 2003/0019107 A1 discloses a shaving device comprising at least one pivotable hair-cutting element. The pivotable hair-cutting element comprises an external cutting member and an internal cutting member, which can be brought into rotation with respect to one another. The shaving device further comprises a motor for driving the internal cutting member, and a drive-shaft mechanism arranged between the hair-cutting element and the motor. The drive-shaft mechanism is resiliently coupled to an output shaft of the motor.

For hair-cutting units of the type as initially identified above there are a number of desirable design requirements when applied in such a shaving device.

In terms of user comfort and shaving smoothness, it is desirable to provide such a shaving device with a considerable skin-contour-following capacity. This may involve a certain pivotability of the one or more hair-cutting elements and/or a certain flexibility of the support of the one or more hair-cutting elements within the shaving device to provide an evasive movement in reaction to external forces. Further, biasing elements may be provided that urge the at least one hair-cutting element into a predefined position.

However, at the same time, it is necessary to transmit the driving force and/or driving torque from the motor of the shaving device to the at least one hair-cutting element. Hence, the greater the skin-contour-following capacity is, the greater the required compensating movements will be. Consequently, the drive-shaft mechanism(s) between the motor and the one or more hair-cutting elements has/have to compensate considerable orientation deviations and/or position deviations during operation of the shaving device.

Further, it has been observed that in some cases compensating drive-shaft mechanisms that are composed of two telescopic spindle segments are prone to vibrations which may cause noise and/or a certain discomfort for the user. Further, vibrations may also impair the hair cutting/shaving performance. In addition, an increased vibration level may result in increased wear and thus in a reduced service life of the shaving device.

Further, providing the compensating spindles with increased length compensation and/or increased tilting compensation capacities may also result in an increased installation space, which is generally not desirable for hand-held shaving devices.

Hence, improving the skin-contour-following capacity of the shaving device requires certain trade-offs between several desirable design requirements.

SUMMARY OF THE INVENTION

It is an object of the invention to provide a solution according to which the skin-contour-following capacity of a shaving device is improved, while at the same time meeting at least one of the above-explained trade-offs between desirable design requirements.

For that purpose the invention provides a hair-cutting unit according to the appended independent claim 1. Preferable embodiments of the invention are provided by the appended dependent claims 2-13.

Hence, the invention provides a hair-cutting unit for a shaving device, wherein:

the hair-cutting unit comprises a hair-cutting element and a drive-shaft mechanism;

an operation condition of the hair-cutting unit is defined as a condition in which the drive-shaft mechanism is rotating and thereby driving the hair-cutting element when the hair-cutting unit is installed in the shaving device; and the drive-shaft mechanism has a central axis and comprises a first telescopic shaft-segment, a second telescopic shaft-segment, a third telescopic shaft-segment, and a spring mechanism; and wherein, as seen in said operation condition:

the second telescopic shaft-segment is located in-between the first telescopic shaft-segment and the third telescopic shaft-segment, as seen along the central axis, and the hair-cutting element is located on a side of the third telescopic shaft-segment facing away from the second telescopic shaft-segment, as seen along the central axis;

the first telescopic shaft-segment and the second telescopic shaft-segment are interconnected in mutual telescopic engagement along the central axis, and in mutual co-rotation at least around the central axis;

the second telescopic shaft-segment and the third telescopic shaft-segment are interconnected in mutual telescopic engagement along the central axis, and in mutual co-rotation at least around the central axis;

the third telescopic shaft-segment and the hair-cutting element are interconnected in mutual co-rotation at least around the central axis, and in such manner that, at an interconnection location of the third telescopic shaft-segment and the hair-cutting element, the third telescopic shaft-segment is automatically following skin-contour-following movements performed by the hair-cutting element, as seen relative to the central axis;

at said interconnection location of the third telescopic shaft-segment and the hair-cutting element, said skin-contour-following movements are comprising axial following-movement components, which are directed along the central axis, and which are realized by said mutual telescopic engagements of the first telescopic shaft-segment, the second telescopic shaft-segment and the third telescopic shaft-segment;

the spring mechanism is providing spring force pressing the first telescopic shaft-segment and the third telescopic shaft-segment telescopingly away from one another, as seen at least along the central axis; and said spring force of the spring mechanism is transmitted via the third telescopic shaft-segment to the hair-cutting element in order to realize said axial following-movement components of the third telescopic shaft-segment.

Hence, according to the invention the drive-shaft mechanism is based on a triple-segmented telescopic structure having the first, second and third telescopic shaft-segments with their mutual telescopic engagements as specified above, allowing for said axial following-movement components of said skin-contour-following movements. As compared to known double-segmented telescopic structures of drive-shaft mechanisms of hair-cutting units, the triple-segmented telescopic structure of the present invention provides larger ranges for the axial following-movement components of the skin-contour-following movements. These extended ranges for the axial following-movement components in principle do not require increased axial or transverse dimensions of the triple-segmented telescopic structure in its maximally retracted telescopic state as compared to the axial and transverse dimensions of a comparable known double-segmented telescopic structure in its maximally retracted telescopic state. In other words, the invention provides improved ratios of the extents of the skin-contour-following movements over the dimensions of the drive-shaft mechanism in its maximally retracted telescopic state. In yet other words, the invention provides improved skin-contour-following capacity of a shaving device, while at the same time the required installation space for the drive-shaft mechanism remains restricted. This allows for a more effective and still compact shaving device.

It is noted that, according to the invention, the term "mutual telescopic engagement along the central axis" of two respective telescopic shaft-segments is an engagement wherein the two respective telescopic shaft-segments have a maximally retracted condition and a maximally extended condition in which the two respective telescopic shaft-segments are maximally telescopically retracted, respectively maximally telescopically extended along the central axis. At least in the maximally extended condition of the first and second telescopic shaft-segments, an axial end portion of the second telescopic shaft-segment facing the hair-cutting element extends beyond the first telescopic shaft-segment along the central axis and, thereby, is closer to the hair-cutting element than an axial end portion of the first telescopic shaft-segment facing the hair-cutting element. Similarly, at least in the maximally extended condition of the second and the third telescopic shaft-segments, an axial end portion of the third telescopic shaft-segment facing the hair-cutting element extends beyond the second telescopic shaft-segment along the central axis and, thereby, is closer to the hair-cutting element than said axial end portion of the second telescopic shaft-segment facing the hair-cutting element. Consequently, at least in the maximally extended condition of the second and the third telescopic shaft-segments, the interconnection location of the third telescopic shaft-segment and the hair-cutting element extends beyond the second telescopic shaft-element along the central axis and, thereby, is closer to the hair-cutting element than said axial end portion of the second telescopic shaft-segment facing the hair-cutting element.

It is noted that U.S. Pat. No. 3,242,569 A discloses an example of a double-segmented telescopic structure of a drive-shaft mechanism of a hair-cutting unit. This known double-segmented telescopic structure consists of the mutually telescopic spindle segments 3 and 13. This double-segmented telescopic structure 3+13 further comprises an element 15, which is slidable within the telescopic segment 3. However, this element 15 is not a telescopic segment of the double-segmented telescopic structure 3+13, since the whole element 15 always remains fully within the axial overall length of the telescopic segment 3. Due to a ring 19 which is located within the telescopic segment 3, the element 15 can never protrude out of the telescopic segment 3. In fact, the double-segmented telescopic structure 3+13, together with the slidable element 15, the weak spring 9 and the strong spring 10, as disclosed by U.S. Pat. No. 3,242,569 A have totally different design objectives and effects as compared to the present invention. For these different design objectives, see U.S. Pat. No. 3,242,569 A, column 1, lines 21-37, where it is disclosed that a user during shaving may experience automatic transitions between pressure phases in which either the weak spring 9 or the strong spring 10 provides counter pressure when a hair-cutting unit is depressed against the user's skin.

EP 1 902 818 A2 also discloses an example of a double-segmented telescopic structure of a drive-mechanism of a hair-cutting unit, which comprises first and second concentrically arranged outer cutter elements 31, 32 and first and second concentrically arranged inner cutters 40, 50 arranged to co-operate with, respectively, the first and second outer cutter elements 31, 32. This known double-segmented telescopic structure consists of a lower telescopic shaft-segment, comprising a driven gear wheel, and an upper telescopic shaft segment 60 which is coupled to the second inner cutter 50. A cylindrical body 46 is arranged around an upper portion of the upper telescopic shaft-segment 60 and is coupled with the first inner cutter 40. The cylindrical body 46 is pushed in the upward direction by a spring 48 in order to urge the first inner cutter 40 against the first outer cutter element 31. The cylindrical body 46 is not a telescopic shaft-segment of the double-segmented telescopic structure, because the cylindrical body 46 remains fully within the axial overall length of the upper telescopic shaft-segment 60. The function of the cylindrical body 46 is not to telescopically extend the total length of the telescopic structure of the drive-mechanism, but to drive and bias the first inner cutter 40 relative to the first outer cutter element 31.

In a preferable embodiment of the invention, the first telescopic shaft-segment and the second telescopic shaft-segment, as considered in absence of the spring mechanism, have a maximally retracted condition and/or a maximally extended condition in which they are maximally telescopically retracted and/or maximally telescopically extended, respectively, relative to one another by mutual stopping abutment between them, and wherein the drive-shaft mechanism further comprises spacing means for spacing the first telescopic shaft-segment and the second telescopic shaft-segment relative to one another in said operation condition of the hair-cutting unit in such manner that said maximally retracted condition and/or said maximally extended condition of the first telescopic shaft-segment and the second telescopic shaft-segment is/are prevented in said operation condition.

Thanks to said spacing means for spacing the first telescopic shaft-segment and the second telescopic shaft-segment relative to one another in the operation condition, vibrations, which would normally be transmitted from the first telescopic shaft segment to the second telescopic shaft segment by mutual stopping abutment between the first and second telescopic shaft-segments in said maximally retracted condition and/or said maximally extended condition, are effectively prevented from being transmitted from the first telescopic shaft segment to the second telescopic shaft segment in the operation condition.

In a further preferable embodiment of the invention, said spacing means for said spacing the first telescopic shaft-segment and the second telescopic shaft-segment relative to one another comprises guiding means for the mutual telescopic engagement between the first telescopic shaft-segment and the second telescopic shaft-segment, and wherein said guiding means defines a guiding trajectory, at least part of which has a sloped shape relative to the central axis for automatically providing said spacing the first telescopic shaft-segment and the second telescopic shaft-segment relative to one another as a result of said rotating of the drive-shaft mechanism in said operation condition.

Thanks to said sloped shape of the guiding trajectory of the guiding means for the mutual telescopic engagement between the first telescopic shaft-segment and the second telescopic shaft-segment, the spacing means for said spacing the first telescopic shaft-segment and the second telescopic shaft-segment relative to one another self-operates by torque that is exercised on the drive-shaft mechanism. A further advantage of such a realization of the spacing means is that such a sloped shape of such a guiding trajectory can be embodied without additional parts.

In a further preferable embodiment of the invention, a slope angle, relative to the central axis, of said sloped shape of said at least part of said guiding trajectory of said guiding means for the mutual telescopic engagement between the first telescopic shaft-segment and the second telescopic shaft-segment is in the range of between 1° and 50°, more preferably in the range of between 5° and 30°, and yet more preferably in the range of between 10° and 20°.

In a further preferable embodiment of the invention, said spacing means for spacing the first telescopic shaft-segment and the second telescopic shaft-segment relative to one another comprises a sub-spring means of said spring mechanism, wherein said sub-spring means is providing sub-spring force pressing the first telescopic shaft-segment and the second telescopic shaft-segment telescopingly away from one another, as seen at least along the central axis, to thereby at least contribute to said spacing the first telescopic shaft-segment and the second telescopic shaft-segment relative to one another.

Thanks to said sub-spring means of said spring mechanism, the spacing means for said spacing the first telescopic shaft-segment and the second telescopic shaft-segment relative to one another self-operates by said sub-spring force. A further advantage of such a realization of the spacing means is that such a sub-spring means of the spring mechanism may have a double function in that it may at the same time contribute to the main function of the spring mechanism to press the first telescopic shaft-segment and the third telescopic shaft-segment telescopingly away from one another in the operation condition.

In a preferable embodiment of the invention, the second telescopic shaft-segment and the third telescopic shaft-segment, as considered in absence of the spring mechanism, have a maximally retracted condition and/or a maximally extended condition in which they are maximally telescopically retracted and/or maximally telescopically extended, respectively, relative to one another by mutual stopping abutment between them, and wherein the drive-shaft mechanism further comprises spacing means for spacing the second telescopic shaft-segment and the third telescopic shaft-segment relative to one another in said operation condition of the hair-cutting unit in such manner that said maximally retracted condition and/or said maximally extended condition of the second telescopic shaft-segment and the third telescopic shaft-segment is/are prevented in said operation condition.

Thanks to said spacing means for spacing the second telescopic shaft-segment and the third telescopic shaft-segment relative to one another in the operation condition, vibrations, which would normally be transmitted from the second telescopic shaft-segment to the third telescopic shaft-segment by mutual stopping abutment between the second and third telescopic shaft-segments in said maximally retracted condition and/or said maximally extended condition, are effectively prevented from being transmitted from the second telescopic shaft-segment to the third telescopic shaft-segment in the operation condition.

In a further preferable embodiment of the invention, said spacing means for said spacing the second telescopic shaft-segment and the third telescopic shaft-segment relative to one another comprises guiding means for the mutual telescopic engagement between the second telescopic shaft-segment and the third telescopic shaft-segment, and wherein said guiding means defines a guiding trajectory, at least part of which has a sloped shape relative to the central axis for automatically providing said spacing the second telescopic shaft-segment and the third telescopic shaft-segment relative to one another as a result of said rotating of the drive-shaft mechanism in said operation condition.

Thanks to said sloped shape of the guiding trajectory of the guiding means for the mutual telescopic engagement between the second telescopic shaft-segment and the third telescopic shaft-segment, the spacing means for said spacing the second telescopic shaft-segment and the third telescopic shaft-segment relative to one another self-operates by torque that is exercised on the drive-shaft mechanism. A further advantage of such a realization of the spacing means is that such a sloped shape of such a guiding trajectory can be embodied without additional parts.

In a further preferable embodiment of the invention, a slope angle, relative to the central axis, of said sloped shape of said at least part of said guiding trajectory of said guiding means for the mutual telescopic engagement between the second telescopic shaft-segment and the third telescopic shaft-segment is in the range of between 1° and 50°, preferably in the range of between 5° and 30°, more preferably in the range of between 10° and 20°.

In a further preferable embodiment of the invention, said spacing means for spacing the second telescopic shaft-segment and the third telescopic shaft-segment relative to one another comprises a further sub-spring means of said spring mechanism, wherein said further sub-spring means is providing further sub-spring force pressing the second telescopic shaft-segment and the third telescopic shaft-segment telescopingly away from one another, as seen at least along the central axis, to thereby at least contribute to said spacing the second telescopic shaft-segment and the third telescopic shaft-segment relative to one another.

Thanks to said further sub-spring means of said spring mechanism, the spacing means for said spacing the second telescopic shaft-segment and the third telescopic shaft-segment relative to one another self-operates by said further sub-spring force. A further advantage of such a realization of the spacing means is that such a further sub-spring means of the spring mechanism may have a double function in that it may at the same time contribute to the main function of the spring mechanism to press the first telescopic shaft-segment and the third telescopic shaft-segment telescopingly away from one another in the operation condition.

In a further preferable embodiment of the invention:

the first telescopic shaft-segment and the second telescopic shaft-segment, as considered in absence of the spring mechanism, have a maximally retracted condition and/or a maximally extended condition in which they are maximally telescopically retracted and/or maximally telescopically extended, respectively, relative to one another by mutual stopping abutment between them, and wherein the drive-shaft mechanism further comprises spacing means for spacing the first telescopic shaft-segment and the second telescopic shaft-segment relative to one another in said operation condition of the hair-cutting unit in such manner that said maximally retracted condition and/or said maximally extended condition of the first telescopic shaft-segment and the second telescopic shaft-segment is/are prevented in said operation condition;

said spacing means for spacing the first telescopic shaft-segment and the second telescopic shaft-segment relative to one another comprises a sub-spring means of said spring mechanism, wherein said sub-spring means is providing sub-spring force pressing the first telescopic shaft-segment and the second telescopic shaft-segment telescopingly away from one another, as seen at least along the central axis, to thereby at least contribute to said spacing the first telescopic shaft-segment and the second telescopic shaft-segment relative to one another;

the second telescopic shaft-segment and the third telescopic shaft-segment, as considered in absence of the spring mechanism, have a maximally retracted condition and/or a maximally extended condition in which they are maximally telescopically retracted and/or maximally telescopically extended, respectively, relative to one another by mutual stopping abutment between them, and wherein the drive-shaft mechanism further comprises spacing means for spacing the second telescopic shaft-segment and the third telescopic shaft-segment relative to one another in said operation condition of the hair-cutting unit in such manner that said maximally retracted condition and/or said maximally extended condition of the second telescopic shaft-segment and the third telescopic shaft-segment is/are prevented in said operation condition; and said spacing means for spacing the second telescopic shaft-segment and the third telescopic shaft-segment relative to one another comprises a further sub-spring means of said spring mechanism, wherein said further sub-spring means is providing further sub-spring force pressing the second telescopic shaft-segment and the third telescopic shaft-segment telescopingly away from one another, as seen at least along the central axis, to thereby at least contribute to said spacing the second telescopic shaft-segment and the third telescopic shaft-segment relative to one another.

Thanks to said sub-spring means and said further sub-spring means of said spring mechanism, the spacing means for said spacing the first telescopic shaft-segment and the second telescopic shaft-segment relative to one another, and the spacing means for said spacing the second telescopic shaft-segment and the third telescopic shaft-segment relative to one another, self-operate by said sub-spring force and said further sub-spring force, respectively. A further advantage of such a realization of the spacing means is that each of such a sub-spring means and such a further sub-spring means of the spring mechanism may have a double function in that it may at the same time contribute to the main function of the spring mechanism to press the first telescopic shaft-segment and the third telescopic shaft-segment telescopingly away from one another in the operation condition.

In a further preferable embodiment of the invention, said sub-spring means and said further sub-spring means together are providing said spring force of the spring mechanism pressing the first telescopic shaft-segment and the third telescopic shaft-segment telescopingly away from one another, as seen at least along the central axis.

This provides the advantage that the spring mechanism can be embodied without any further parts in addition to said sub-spring means and said further sub-spring means.

In a further preferable embodiment of the invention, at the interconnection location of the third telescopic shaft-segment and the hair-cutting element, said skin-contour following movements are comprising transverse following-movement components, which are transverse to the central axis, and which are realized in that the first telescopic shaft-segment and the second telescopic shaft-segment are in mutual tiltable engagement, as seen relative to the central axis, and/or which are realized in that the second telescopic shaft-segment and the third telescopic shaft-segment are in mutual tiltable engagement, as seen relative to the central axis.

In such kind of preferable embodiments, as compared to known double-segmented telescopic structures of drive-shaft mechanisms of hair-cutting units, the triple-segmented telescopic structure of the present invention provides larger ranges for the axial following-movement components as well as for the transverse following-movement components of the skin-contour-following movements. These extended ranges for the axial and transverse following-movement components in principle do not require increased axial or transverse dimensions of the triple-segmented telescopic structure in its maximally retracted telescopic state as compared to the axial and transverse dimensions of a comparable known double-segmented telescopic structure in its maximally retracted telescopic state. This further contributes to a more effective and still compact shaving device.

Furthermore, the invention is embodied in a shaving device for skin hairs, comprising at least one hair-cutting unit according to the invention and a shaving device main body, which is intended to be taken hold of by a user of the shaving device, and which serves for accommodating various members of the shaving device, and wherein the at least one hair-cutting unit is connected to the shaving device main body for operation of the shaving device.

BRIEF DESCRIPTION OF THE DRAWINGS

The abovementioned aspects and other aspects of the invention will be apparent from and elucidated with reference to the embodiments described hereinafter by way of non-limiting examples only and with reference to the schematic figures in the enclosed drawing.

The reference signs used in the abovementioned FIGS. 1-7 are referring to the abovementioned parts and aspects of the invention, as well as to related parts and aspects, in the following manner.

Figure 1A:
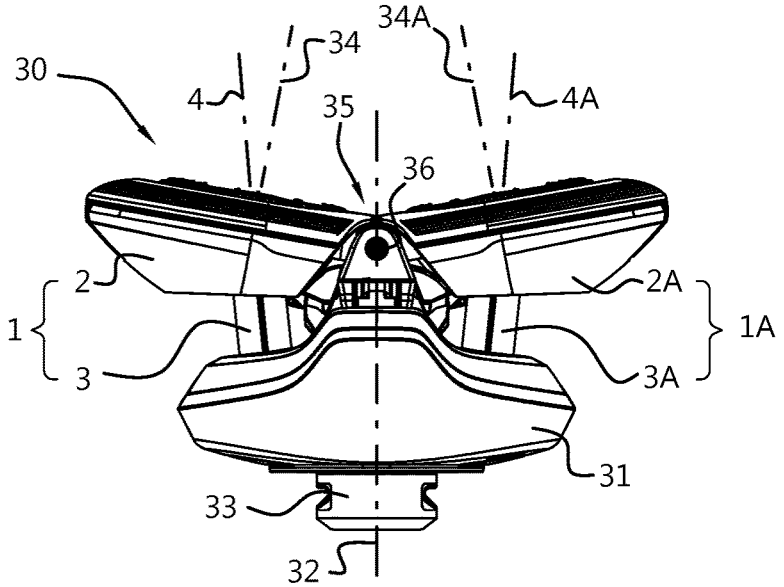
FIG. 1A shows, in a side view, an example of a shaving head of a shaving device, wherein the shown shaving head comprises two mutually identical hair-cutting units according to an example of an embodiment of the invention.

1, 1A hair-cutting unit
2, 2A hair-cutting element
3, 3A; 103 drive-shaft mechanism
4, 4A central axis
5; 105A, 105B spring mechanism
105A sub-spring means
105B further sub-spring means
6 interconnection location
7 slope angle
11 axial following-movement components
12 transverse following-movement components
14, 15 guiding means
21; 121 first telescopic shaft-segment
22; 122 second telescopic shaft-segment
23; 123 third telescopic shaft-segment
30 shaving head
31 transmission unit
32 main-drive axis
33 coupling member
34, 34A rotation axis
35 central member
36 primary pivot axis
40 gear wheel
41 first circumferential wall
42 second circumferential wall
43 third circumferential wall
44 helical slot
45 axial slot
46 protrusion In FIGS. 1-7 sometimes the same reference numerals have been used for parts and aspects which are alike for the different embodiments shown in these figures.

DETAILED DESCRIPTION OF EMBODIMENTS

Based on the above introductory description, including the brief description of the drawing figures, and based on the above-explained reference signs used in the drawing, the shown examples of FIGS. 1-7 are for the greatest part readily self-explanatory. The following extra explanations are given.

Figure 1B:
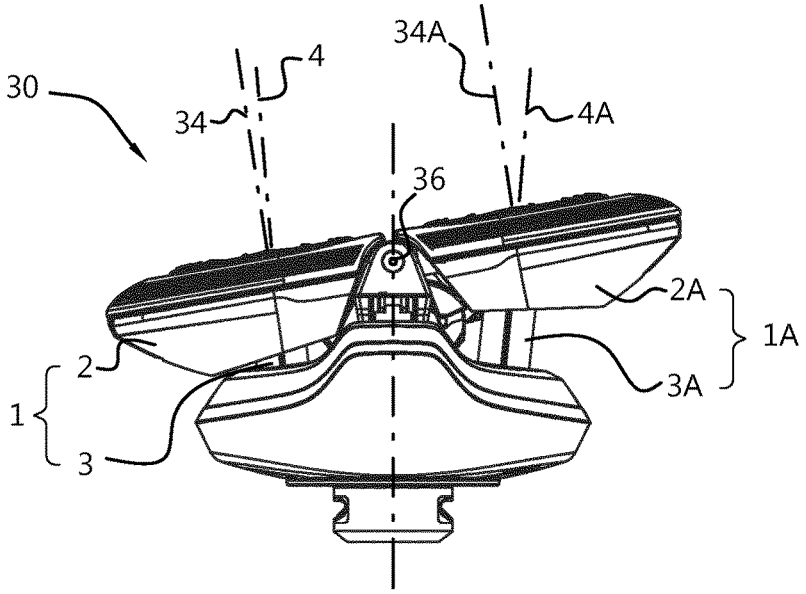
FIG. 1B shows the shaving head of FIG. 1A again, however, wherein this time the hair-cutting element of the hair-cutting unit shown on the left is in a different orientation relative to the central axis of the corresponding drive-shaft mechanism, wherein said different orientation may for example be caused by skin-contour-following movements having been performed by the hair-cutting element.
Figure 1C:
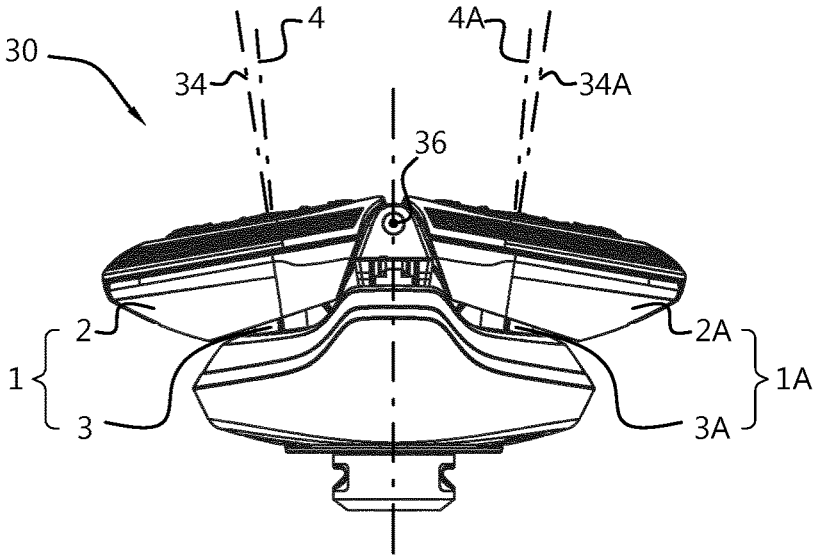
FIG. 1C shows the shaving head of FIG. 1B again, however, wherein this time also the hair-cutting element of the hair-cutting unit shown on the right is in a different orientation relative to the central axis of the corresponding drive-shaft mechanism.

Reference is first made to FIGS. 1A-1C, which show the shaving head 30 with its two mutually identical hair-cutting units 1, 1A according to the invention. The hair-cutting units 1, 1A are comprising the respective hair-cutting elements 2, 2A and the respective drive-shaft mechanisms 3, 3A with their respective central axes 4, 4A. Each hair-cutting element 2, 2A has an external cutting member and an internal cutting member (not shown in detail). The external cutting member has a plurality of hair entry openings. The internal cutting member is rotatable relative to the external cutting member around a rotation axis. The rotation axes of the hair-cutting elements 2, 2A are indicated by the respective reference numerals 34, 34A.

The internal cutting members are coupled via the respective drive-shaft mechanisms 3, 3A to a transmission unit 31 of the shaving head 30. The transmission unit 31 may comprise a set of transmission gear wheels for transmitting the rotational motion of a main-drive shaft, which is rotatable about a main-drive axis 32, into rotational motions of the drive-shaft mechanism 3, 3A. The main-drive shaft, which is not shown in FIGS. 1A-1C, is accommodated in a coupling member 33 of the shaving head 30. By means of the coupling member 33, the shaving head 30 can be releasably coupled to a main body (not shown) of a shaving device. The coupling member 33 is part of a central member 35 of the shaving head 30.

The hair-cutting elements 2, 2A are mounted to the central member 35 in a mutually independent pivotable manner about the primary pivot axis 36. FIGS. 1A-1C show some different pivot positions of the hair-cutting elements 2, 2A about this primary pivot axis 36. It is noted that the hair-cutting elements 2, 2A may, alternatively, also be pivotable about two different, e.g. mutually parallel, such primary pivot axes. It is further noted that the hair-cutting elements 2, 2A may, additional to the pivotability about one or two such primary pivot axes, also be pivotable relative to one or two secondary pivot axes being, e.g., orthogonal to the one or two such primary pivot axes.

From FIGS. 1A-1C it will now be clear that the telescopic drive-shaft mechanisms 3, 3A applied in the shaving head 30 must be able to provide very large effective ranges for the axial following-movement components as well as for the transverse following-movement components of the skin-contour-following movements performed by the hair-cutting elements 2, 2A.

From FIGS. 2-6, which are showing the drive-shaft mechanism 3 in more detail, it will be readily appreciated that the abovementioned very large effective ranges for the axial and transverse following-movement components (see FIG. 2, arrows 11, 12, respectively) do not require considerable axial or transverse dimensions of the triple-segmented telescopic structure of the drive-shaft mechanism 3 in its maximally retracted telescopic state. After all, as compared to the conventional double-segmented telescopic structures, the triple-segmented telescopic structure allows for larger axial extension without need to elongate the longest segment of the triple-segmented telescopic structure, so without need to increase the axial dimension of the triple-segmented telescopic structure in the maximally retracted state. Furthermore, thanks to said larger axial extension, the interconnection location 6 at the free end of the third telescopic shaft-segment 23 will automatically be allowed to perform greater transverse movements, as compared to the conventional double-segmented telescopic structures, without need to increase the transverse play between the segments, so without need to increase the transverse dimension of the triple-segmented telescopic structure in the maximally retracted state. In other words, the invention provides improved skin-contour-following capacity of a shaving device, while at the same time the required installation space for the drive-shaft mechanism remains restricted. This allows for a more effective and still compact shaving device.

The shown example of FIGS. 2-6 has the following further particulars.

The first telescopic shaft-segment 21 has a gear wheel 40 to be engaged within the transmission unit 31 of the shaving head 30 (see FIG. 1A). The first telescopic shaft-segment 21 and the second telescopic shaft-segment 22 are in mutual tiltable engagement, as seen relative to the central axis 4. In the shown example, the second telescopic shaft-segment 22 and the third telescopic shaft-segment 23 are not in such a mutual tiltable engagement. The spring mechanism 5 is embodied as a single compression spring 5, which presses the first and second telescopic shaft-segments 21, 22 telescopingly away from one another. The first, second and third telescopic shaft-segments 21, 22, 23 have respective first, second and third circumferential walls 41, 42, 43. The first circumferential wall 41 has three helical slots 44, which are mutually identical and which are equally spaced in circumferential direction around the central axis 4. Each helical slot 44 is bounded by, inter alia, a sloped contact surface 14. The second circumferential wall 42 has three protrusions 15, which are slidable within the three slots 44. The second circumferential wall 42 has three axial slots 45, which are mutually identical and which are equally spaced in circumferential direction around the central axis 4. The third circumferential wall 43 has three protrusions 46, which are slidable within the three axial slots 45.

As follows from FIG. 3, each sloped contact surface 14 has a slope angle 7 relative to the central axis 4. It will now be elucidated that the sloped contact surfaces 14 together with the protrusions 15 are forming the abovementioned spacing means for spacing the first telescopic shaft-segment 21 and the second telescopic shaft-segment 22 relative to one another in the operation condition of the hair-cutting unit 1 in such manner that the maximally retracted condition of the first telescopic shaft-segment 21 and the second telescopic shaft-segment 22 is prevented in the operation condition. More specifically it will now be elucidated that said spacing means for said spacing the first telescopic shaft-segment and the second telescopic shaft-segment relative to one another self-operates by torque that is exercised on the drive-shaft mechanism 3.

For that purpose, an operation condition is now considered in which, via the gear wheel 40, a driving torque is exercised on the drive-shaft mechanism 3. Then, thanks to the slope angles 7 of the three sloped contact surfaces 14, said driving torque will create, in threefold, an axial force component (i.e. directed parallel to the central axis 4), acting from each sloped contact surface 14 onto each of the three protrusions 15. These three axial force components will push the second telescopic shaft-segment 22 farther out of the first telescopic shaft-segment 21, while the second telescopic shaft-segment 22 may move freely along the third telescopic shaft-segment 23. Thereby, the first telescopic shaft-segment 21 and the second telescopic shaft-segment 22 will remain spaced relative to one another in operation condition of the hair-cutting unit in such manner that the maximally retracted condition of the first telescopic shaft-segment and the second telescopic shaft-segment is prevented in said operation condition. Thanks to these spacing means 14, 15 for mutually spacing the first and second telescopic shaft-segments 21, 22 in operation, vibrations, which would otherwise be transmitted from the first telescopic shaft-segment 21 to the second telescopic shaft-segment 22 by mutual stopping abutment between the first and second telescopic shaft-segments in said maximally retracted condition, are effectively prevented from being transmitted from the first telescopic shaft-segment 21 to the second telescopic shaft-segment 22 in operation.

Figure 2:
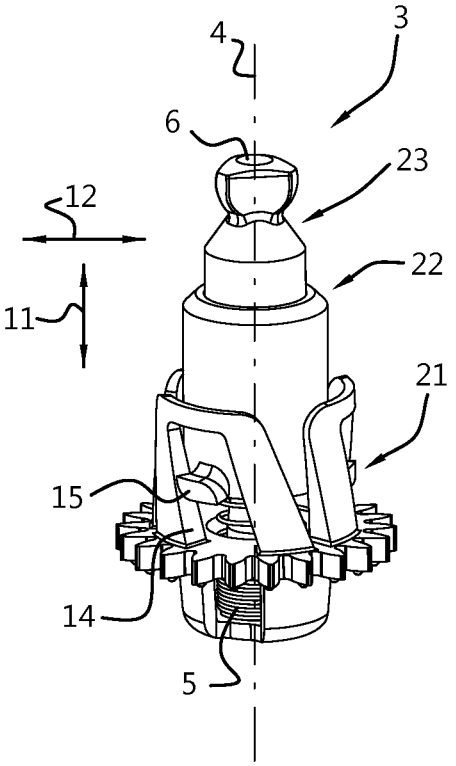
FIG. 2 separately shows, in a perspective view, the drive-shaft mechanism of the hair-cutting unit, which is shown on the left in FIGS. 1A-1C, wherein the drive-shaft mechanism is in a considerably retracted state, though not yet maximally contracted.
Figure 3:
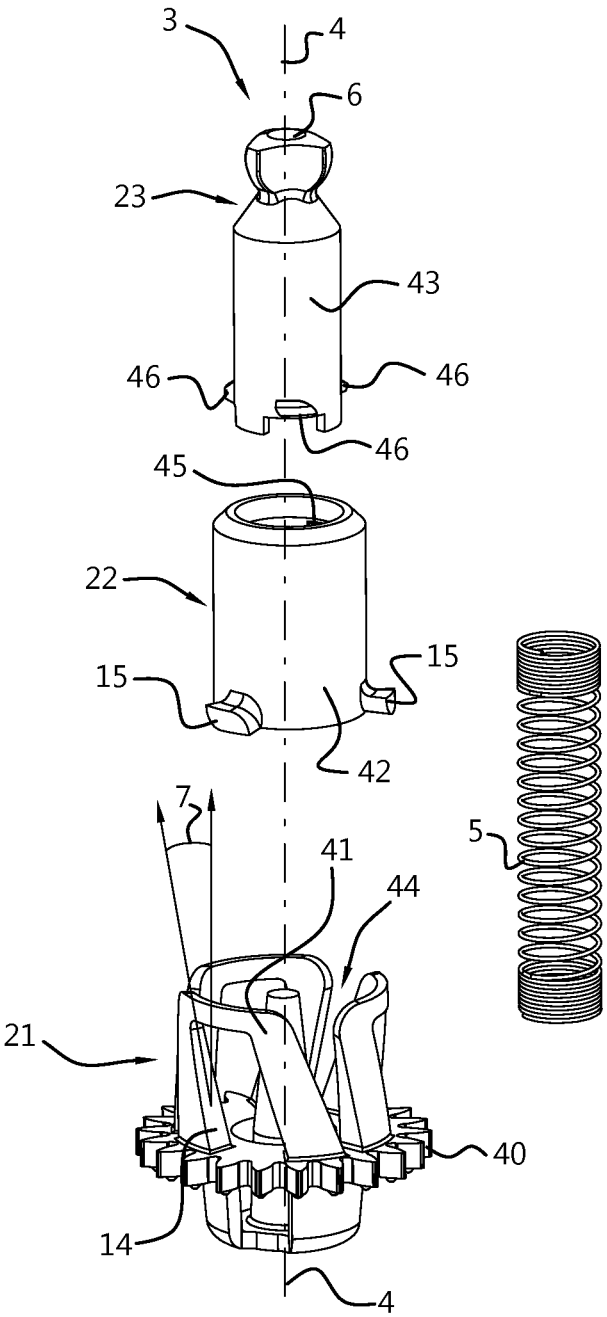
FIG. 3 is an exploded view of the drive-shaft mechanism of FIG. 2.
Figure 4:
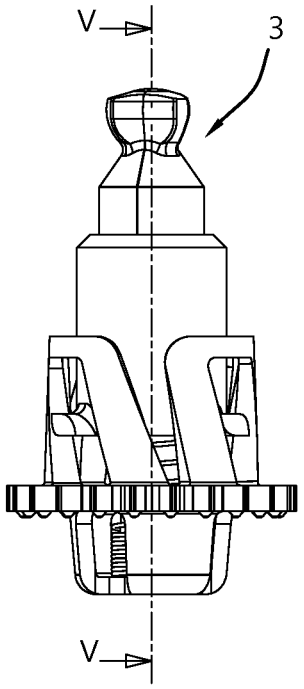
FIG. 4 is a side view of the drive-shaft mechanism of FIG. 2.
Figure 6:
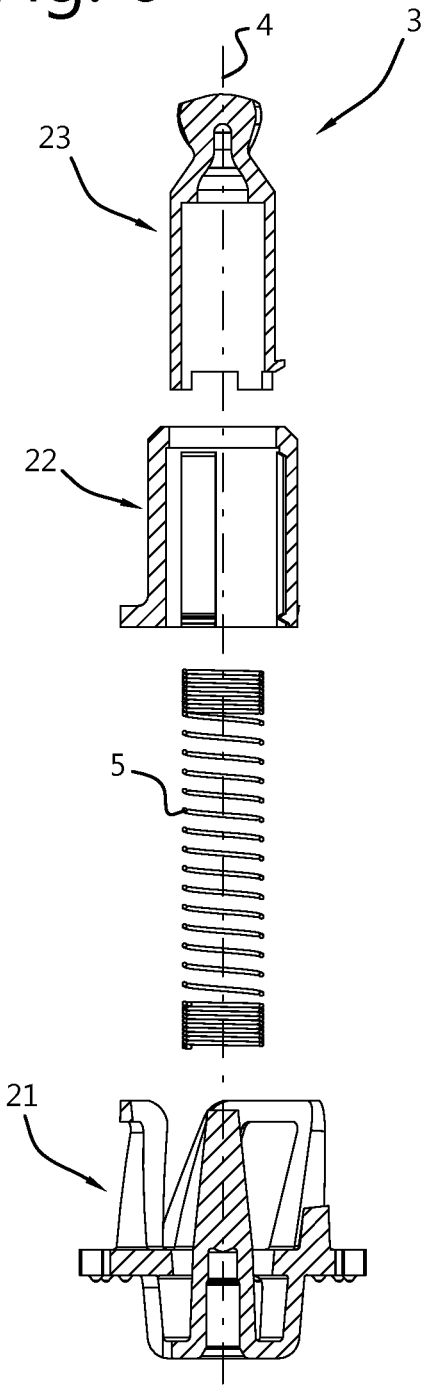
FIG. 6 is an exploded view of the drive-shaft mechanism of FIG. 5.

In the embodiment shown in FIGS. 2 and 3 as described here before, said mutual tiltable engagement of the first and second telescopic shaft-segments 21 and 22 is enabled by the spacing which is present between the protrusions 15 and the slots 44, and by the spacing which is present between the second circumferential wall 42 of the second telescopic shaft-segment 22 and the first circumferential wall 41 of the first telescopic shaft-segment 21. In a particular embodiment not shown in the figures, the first circumferential wall 41 has an axial length in the direction of the central axis 4 which is small relative to the axial lengths of the second circumferential wall 42 and of the third circumferential wall 43. As a result, in this embodiment the axial displacement of the second telescopic shaft-segment 22 away from the first telescopic shaft-segment 21 by the axial forces created by the interaction of the protrusions 15 and the slots 44 as described here before, is relatively small. Said axial displacement though will still prevent the maximally retracted condition of the first and second telescopic shaft-segments 21 and 22 in the operation condition and, thus, will still prevent the transmission of vibrations from the first telescopic shaft-segment 21 to the second telescopic shaft-segment 22. Although in this embodiment the contribution of the mutual telescopic arrangment of the first and second telescopic shaft-segments 21 and 22 to the overall axial extension of the length of the drive-shaft mechanism 3 is limited, this embodiment has the following advantages in addition to the prevention of the transmission of vibrations during the operation condition as described before.

First, the relatively small axial length of the first circumferential wall 41 limits the range for the positions of the tilting point between the first and second telescopic shaft-segments 21 and 22. Since the second and the third telescopic shaft-segments 22 and 23 are not in mutual tiltable engagement, also the range for the positions of the tilting point of the third telescopic shaft-segment 23 relative to the first telescopic shaft-segment 21, and in particular the range for the positions of the tilting point of the interconnection location 6 at the free end of the third telescopic shaft-segment 23 relative to the first telescopic shaft-segment 21, are limited. Said limited ranges of said tilting points allows to reduce the size of the opening in the housing of the transmission unit 31 through which the drive-shaft mechanism 3 extends. The reduced size of said opening leads to a more aesthetic design and an improved perception of quality, while it also minimizes the penetration of undesired substances and objects (e.g. heard hairs) into the transmission unit 31.

A second advantage of the relatively small axial length of the first circumferential wall 41 is that the first telescopic shaft-segment 21 can be fully accommodated in the housing of the transmission unit 31 without any substantial increase of the required dimensions of said housing. Also this leads to a more aesthetic design, as only the relatively smooth second and third telescopic shaft-segments 22 and 23 will be visible to the user.

Figure 5:
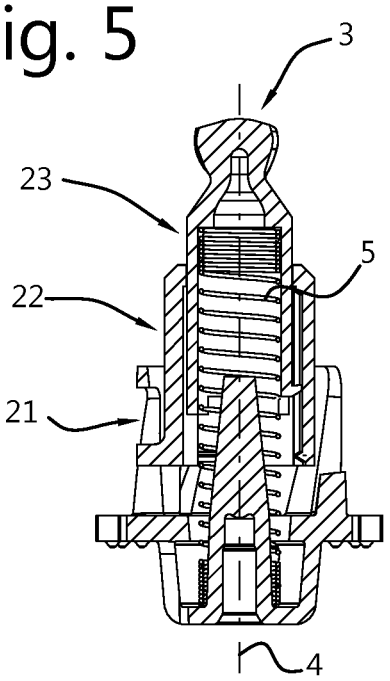
FIG. 5 is a cross-sectional view taken along the line V-V in FIG. 4.
Figure 7:
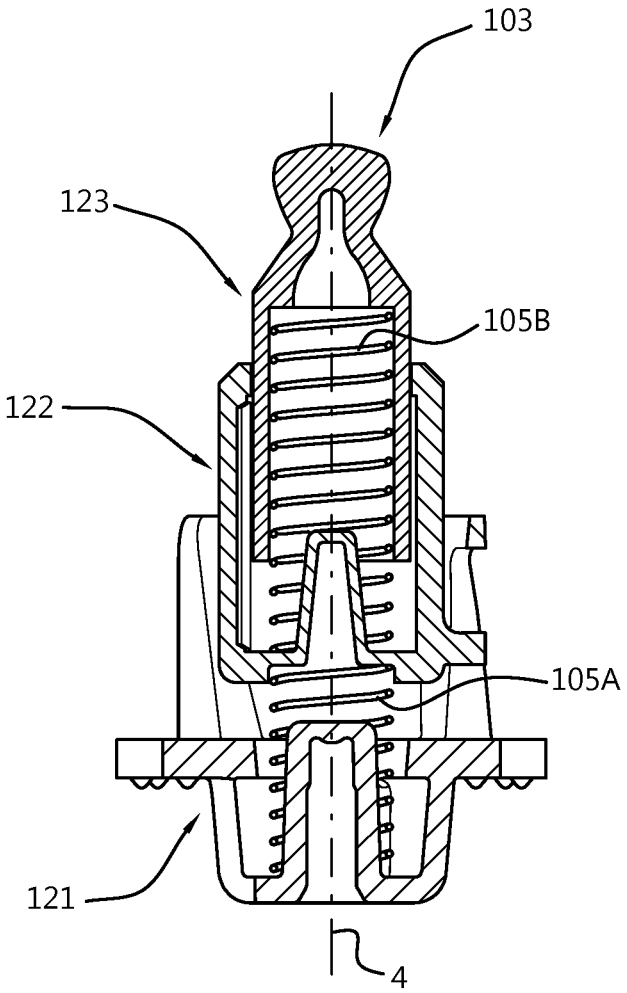
FIG. 7 shows an example of another embodiment of a drive-shaft mechanism of a hair-cutting unit according to the invention, in a situation and a cross-sectional view similar to those of FIG. 5.

Reference is now made to FIG. 7, which shows an example of another embodiment of a drive-shaft mechanism of a hair-cutting unit according to the invention, in a situation and a cross-sectional view similar to those of FIG. 5. The drive-shaft mechanism of FIG. 7 is indicated by the reference numeral 103, and its first, second and third telescopic shaft-segments are indicated by the reference numerals 121, 122 and 123, respectively. The spring means of the drive-shaft mechanism 103 comprises the abovementioned sub-spring means, as well as the abovementioned further sub-spring means. More specifically, in the shown example of FIG. 7, said sub-spring means is embodied as the shown compression spring 105A, while said further sub-spring means is embodied as the shown compression spring 105B.

In the shown example, the compression spring 105A is forming the abovementioned spacing means for spacing the first telescopic shaft-segment 121 and the second telescopic shaft-segment 122 relative to one another, to thereby prevent the transmission of vibrations from the first telescopic shaft-segment 121 to the second telescopic shaft-segment 122 which would otherwise occur by mutual stopping abutment between the first and second telescopic shaft-segments 121, 122 in their maximally retracted position. The compression spring 105B is forming the abovementioned spacing means for spacing the second telescopic shaft-segment 122 and the third telescopic shaft-segment 123 relative to one another, to thereby prevent the transmission of vibrations from the second telescopic shaft-segment 122 to the third telescopic shaft-segment 123 which would otherwise occur by mutual stopping abutment between the second and third telescopic shaft-segments in their maximally retracted position.

At the same time, these two compression springs 105A and 105B together are providing the abovementioned spring force of the spring mechanism of the drive-shaft mechanism 103, pressing the first telescopic shaft-segment 121 and the third telescopic shaft-segment 123 telescopingly away from one another.

While the invention has been described and illustrated in detail in the foregoing description and in the drawing figures, such description and illustration are to be considered exemplary and/or illustrative and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. For the purpose of clarity and a concise description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures cannot be used to advantage. Any reference signs in the claims should not be construed as limiting the scope.

The invention claimed is:

1. A hair-cutting unit for a shaving device, wherein:

the hair-cutting unit comprises a hair-cutting element and a drive-shaft;

an operation condition of the hair-cutting unit is defined as a condition in which the drive-shaft is rotating and thereby driving the hair-cutting element when the hair-cutting unit is installed in the shaving device; and the drive-shaft has a central axis and comprises a first telescopic shaft-segment, a second telescopic shaft-segment, a third shaft-segment, and a spring;

and wherein, as seen in said operation condition:

the second telescopic shaft-segment is located in-between the first telescopic shaft-segment and the third shaft-segment, as seen along the central axis, and the hair-cutting element is located on a side of the third shaft-segment facing away from the second telescopic shaft-segment, as seen along the central axis;

the first telescopic shaft-segment and the second telescopic shaft-segment are interconnected in mutual telescopic engagement along the central axis, and in mutual co-rotation at least around the central axis;

the second telescopic shaft-segment and the third shaft-segment are interconnected in mutual co-rotation at least around the central axis;

the third shaft-segment and the hair-cutting element are interconnected in mutual co-rotation at least around the central axis, and in such manner that, at an interconnection location of the third shaft-segment and the hair-cutting element, the third shaft-segment is following skin-contour-following movements performed by the hair-cutting element, as seen relative to the central axis;

at said interconnection location of the third shaft-segment and the hair-cutting element, said skin-contour-following movements are comprising axial following-movement components, which are directed along the central axis, and which are realized by said mutual telescopic engagements of the first telescopic shaft-segment and the second telescopic shaft-segment; and said spring force of the spring is transmitted via the third shaft-segment to the hair-cutting element in order to realize said axial following-movement components of the third shaft-segment;

characterized in that:

the third shaft-segment of the drive-shaft is a telescopic shaft-segment;

the second telescopic shaft-segment and the third telescopic shaft-segment are interconnected in mutual telescopic engagement along the central axis;

the axial following-movement components of said skin-contour-following movements at the interconnection location of the third telescopic shaft-segment and the hair-cutting element are realized by said mutual telescopic engagements of the first telescopic shaft-segment, the second telescopic shaft-segment and the third-telescopic shaft-segment; and the spring is providing spring force pressing the first telescopic shaft-segment and the third telescopic shaft-segment telescopingly away from one another, as seen at least along the central axis.

2. The hair-cutting unit according to claim 1, wherein the first telescopic shaft-segment and the second telescopic shaft-segment have a maximally retracted condition and/or a maximally extended condition in which they are maximally telescopically retracted and/or maximally telescopically extended, respectively, relative to one another by mutual stopping abutment between them, and wherein the drive-shaft further comprises spacing means for spacing the first telescopic shaft-segment and the second telescopic shaft-segment relative to one another in said operation condition of the hair-cutting unit in such manner that said maximally retracted condition and/or said maximally extended condition of the first telescopic shaft-segment and the second telescopic shaft-segment is/are prevented in said operation condition.

3. The hair-cutting unit according to claim 2, wherein said spacing means for said spacing the first telescopic shaft-segment and the second telescopic shaft-segment relative to one another comprises guiding means for the mutual telescopic engagement between the first telescopic shaft-segment and the second telescopic shaft-segment, and wherein said guiding means defines a guiding trajectory, at least part of which has a sloped shape relative to the central axis for providing said spacing the first telescopic shaft-segment and the second telescopic shaft-segment relative to one another as a result of said rotating of the drive-shaft in said operation condition.

4. The hair-cutting unit according to claim 3, wherein a slope angle, relative to the central axis, of said sloped shape of said at least part of said guiding trajectory of said guiding means for the mutual telescopic engagement between the first telescopic shaft-segment and the second telescopic shaft-segment is in the range of between 1° and 50°.

5. The hair-cutting unit according to claim 2, wherein said spacing means for spacing the first telescopic shaft-segment and the second telescopic shaft-segment relative to one another comprises a sub-spring means of said spring, wherein said sub-spring means is providing sub-spring force pressing the first telescopic shaft-segment and the second telescopic shaft-segment telescopingly away from one another, as seen at least along the central axis, to thereby at least contribute to said spacing the first telescopic shaft-segment and the second telescopic shaft-segment relative to one another.

6. The hair-cutting unit according to claim 1, wherein the second telescopic shaft-segment and the third telescopic shaft-segment have a maximally retracted condition and/or a maximally extended condition in which they are maximally telescopically retracted and/or maximally telescopically extended, respectively, relative to one another by mutual stopping abutment between them, and wherein the drive-shaft further comprises spacing means for spacing the second telescopic shaft-segment and the third telescopic shaft-segment relative to one another in said operation condition of the hair-cutting unit in such manner that said maximally retracted condition and/or said maximally extended condition of the second telescopic shaft-segment and the third telescopic shaft-segment is/are prevented in said operation condition.

7. The hair-cutting unit according to claim 6, wherein said spacing means for said spacing the second telescopic shaft-segment and the third telescopic shaft-segment relative to one another comprises guiding means for the mutual telescopic engagement between the second telescopic shaft-segment and the third telescopic shaft-segment, and wherein said guiding means defines a guiding trajectory, at least part of which has a sloped shape relative to the central axis for providing said spacing the second telescopic shaft-segment and the third telescopic shaft-segment relative to one another as a result of said rotating of the drive-shaft in said operation condition.

8. The hair-cutting unit according to claim 7, wherein a slope angle, relative to the central axis, of said sloped shape of said at least part of said guiding trajectory of said guiding means for the mutual telescopic engagement between the second telescopic shaft-segment and the third telescopic shaft-segment is in the range of between 1° and 50°.

9. The hair-cutting unit according to claim 6, wherein said spacing means for spacing the second telescopic shaft-segment and the third telescopic shaft-segment relative to one another comprises a further sub-spring means of said spring, wherein said further sub-spring means is providing further sub-spring force pressing the second telescopic shaft-segment and the third telescopic shaft-segment telescopingly away from one another, as seen at least along the central axis, to thereby at least contribute to said spacing the second telescopic shaft-segment and the third telescopic shaft-segment relative to one another.

10. The hair-cutting unit according to claim 1, wherein:

the first telescopic shaft-segment and the second telescopic shaft-segment have a maximally retracted condition and/or a maximally extended condition in which they are maximally telescopically retracted and/or maximally telescopically extended, respectively, relative to one another by mutual stopping abutment between them, and wherein the drive-shaft further comprises spacing means for spacing the first telescopic shaft-segment and the second telescopic shaft-segment relative to one another in said operation condition of the hair-cutting unit in such manner that said maximally retracted condition and/or said maximally extended condition of the first telescopic shaft-segment and the second telescopic shaft-segment is/are prevented in said operation condition;

said spacing means for spacing the first telescopic shaft-segment and the second telescopic shaft-segment relative to one another comprises a sub-spring means of said spring, wherein said sub-spring means is providing sub-spring force pressing the first telescopic shaft-segment and the second telescopic shaft-segment telescopingly away from one another, as seen at least along the central axis, to thereby at least contribute to said spacing the first telescopic shaft-segment and the second telescopic shaft-segment relative to one another;

the second telescopic shaft-segment and the third telescopic shaft-segment have a maximally retracted condition and/or a maximally extended condition in which they are maximally telescopically retracted and/or maximally telescopically extended, respectively, relative to one another by mutual stopping abutment between them, and wherein the drive-shaft further comprises spacing means for spacing the second telescopic shaft-segment and the third telescopic shaft-segment relative to one another in said operation condition of the hair-cutting unit in such manner that said maximally retracted condition and/or said maximally extended condition of the second telescopic shaft-segment and the third telescopic shaft-segment is/are prevented in said operation condition; and said spacing means for spacing the second telescopic shaft-segment and the third telescopic shaft-segment relative to one another comprises a further sub-spring means of said spring, wherein said further sub-spring means is providing further sub-spring force pressing the second telescopic shaft-segment and the third telescopic shaft-segment telescopingly away from one another, as seen at least along the central axis, to thereby at least contribute to said spacing the second telescopic shaft-segment and the third telescopic shaft-segment relative to one another.

11. The hair-cutting unit according to claim 10, wherein said sub-spring means and said further sub-spring means together are providing said spring force of the spring pressing the first telescopic shaft-segment and the third telescopic shaft-segment telescopingly away from one another, as seen at least along the central axis.

12. The hair-cutting unit according to claim 1, wherein:

at said interconnection location of the third telescopic shaft-segment and the hair-cutting element, said skin-contour following movements are comprising transverse following-movement components, which are transverse to the central axis, and which are realized in that the first telescopic shaft-segment and the second telescopic shaft-segment are in mutual tiltable engagement, as seen relative to the central axis, and/or which are realized in that the second telescopic shaft-segment and the third telescopic shaft-segment are in mutual tiltable engagement, as seen relative to the central axis.

13. A shaving device for skin hairs, comprising at least one hair-cutting unit according to claim 1 and a handle, which is intended to be taken hold of by a user of the shaving device wherein the at least one hair-cutting unit is connected to the handle for operation of the shaving device.

* * * * *